US007584941B2

(12) United States Patent
Epplin et al.

(10) Patent No.: US 7,584,941 B2
(45) Date of Patent: Sep. 8, 2009

(54) METHOD AND APPARATUS FOR OPERATING AN IMPLEMENT FOR A MACHINE

(75) Inventors: Gregory A. Epplin, Apex, NC (US); James A. Oliver, Clayton, NC (US); Ben A. Davila, Corenc (FR); William R. Most, Sparland, IL (US)

(73) Assignee: Caterpillar Inc., Peoria, IL (US)

( * ) Notice: Subject to any disclaimer, the term of this patent is extended or adjusted under 35 U.S.C. 154(b) by 27 days.

(21) Appl. No.: 11/967,352

(22) Filed: Dec. 31, 2007

(65) Prior Publication Data

US 2008/0224112 A1 Sep. 18, 2008

Related U.S. Application Data

(60) Provisional application No. 60/882,978, filed on Dec. 31, 2006.

(51) Int. Cl.
*B66D 1/00* (2006.01)

(52) U.S. Cl. ..... 254/323

(58) Field of Classification Search ..... 254/323, 254/277, 279, 315–317

See application file for complete search history.

(56) References Cited

U.S. PATENT DOCUMENTS 3,695,377 A 10/1972 Ito et al.
4,018,424 A 4/1977 Latimer
4,042,215 A 8/1977 Hakes
4,048,799 A 9/1977 Golan et al.
4,076,219 A 2/1978 Behrends et al.
4,078,770 A 3/1978 Yates et al.
4,161,126 A 7/1979 Winzeler
4,440,041 A 4/1984 Bendtsen
4,458,791 A 7/1984 Schneider
4,560,148 A 12/1985 Palmer
4,746,100 A 5/1988 Davenport et al.
5,692,735 A * 12/1997 Aho et al. ..... 254/323
6,446,731 B1 * 9/2002 Sorosky ..... 169/24
6,523,806 B2 * 2/2003 Bartal ..... 254/323
6,543,749 B1 * 4/2003 Duvall ..... 254/323
6,882,917 B2 * 4/2005 Pillar et al. ..... 701/48
7,419,137 B2 * 9/2008 Boon ..... 254/323

* cited by examiner

*Primary Examiner*—Emmanuel M Marcelo
(74) *Attorney, Agent, or Firm*—Wiliam Beckman

(57) ABSTRACT

A method and apparatus for operating an implement for a machine is provided. The machine has a body, a pump, an implement, an operator station, a first operator input device, and a second operator input device. The pump is mounted to the body and has a first operating range. The implement is mounted to the body and coupled to the pump. The operator station is positioned on the body. The first operator input device is located within the operator station and operable to control the implement over the first operating range and the second operator input device is positioned external to the operator station and operable to control the implement over a second operating range. The second operating range is less than the first operating range.

12 Claims, 3 Drawing Sheets

METHOD AND APPARATUS FOR OPERATING AN IMPLEMENT FOR A MACHINE

CLAIM FOR PRIORITY

The present application claims priority from U.S. Provisional Application Ser. No. 60/882,978, filed Dec. 31, 2006, which is fully incorporated herein.

TECHNICAL FIELD

This disclosure relates generally to a method and apparatus for operating an implement for a machine, and more particularly, to a method and apparatus for operating a winch for a machine having a first and a second operator input.

BACKGROUND

Machines such as skid steer loaders, multi-terrain loaders, track-type tractors, tracked loaders, etc., generally have an engine powering some type of hydraulic system for propelling the machine or providing hydraulic power to linkages. These machines may also use the engine to power an auxiliary implement, such as a winch. Typically, the linkage and the auxiliary implement are controlled by an operator input, such as a joystick, lever, or switch positioned within an operator cab. The operator cab may include a rollover protective structure (ROPS) and/or a falling object protective structure (FOPS).

While the use of an operator input while in the operator cab is desired for most applications, some applications may necessitate some degree of remote control. For example, winches are frequently used for extracting tree stumps by means of a line secured around the trunk and attached to the winch. When an unassisted operator performs a tree extraction using a winch, the operator must frequently leave the cab to extend the winch and secure the line about a tree, then climb back up into the cab to retract the line. If the operator did not properly secure the line, or if the line was caught on an obstruction, the line may fall off the tree when the line is retracted, requiring the operator to leave the cab and repeat the process.

The present disclosure is directed to overcoming one or more of the problems as set forth above.

SUMMARY

In one aspect of the present disclosure, a machine is provided. The machine has a body, a pump, an implement, an operator station, a first operator input device, and a second operator input device. The pump is mounted to the body and has a first operating range. The implement is mounted to the body and coupled to the pump. The operator station is positioned on the body. The first operator input device is located within the operator station and operable to control the implement over the first operating range and the second operator input device is positioned external to the operator station and operable to control the implement over a second operating range. The second operating range is less than the first operating range.

In another aspect of the present disclosure, a method of operating an implement for a machine is provided. The machine has a body, a pump mounted to the body that powers the implement over a first operating range, an operator station positioned on the body, a first operator input device located within the operator station, and a second operator input device positioned external to the operator station. The method includes the step of operating the implement over the first operating range when a command from the first operator input device is received. The method also includes the step of operating the implement over a second operating range when a command from the second operator input device is received, wherein the second operating range is less than the first operating range.

DETAILED DESCRIPTION

Figure 1:
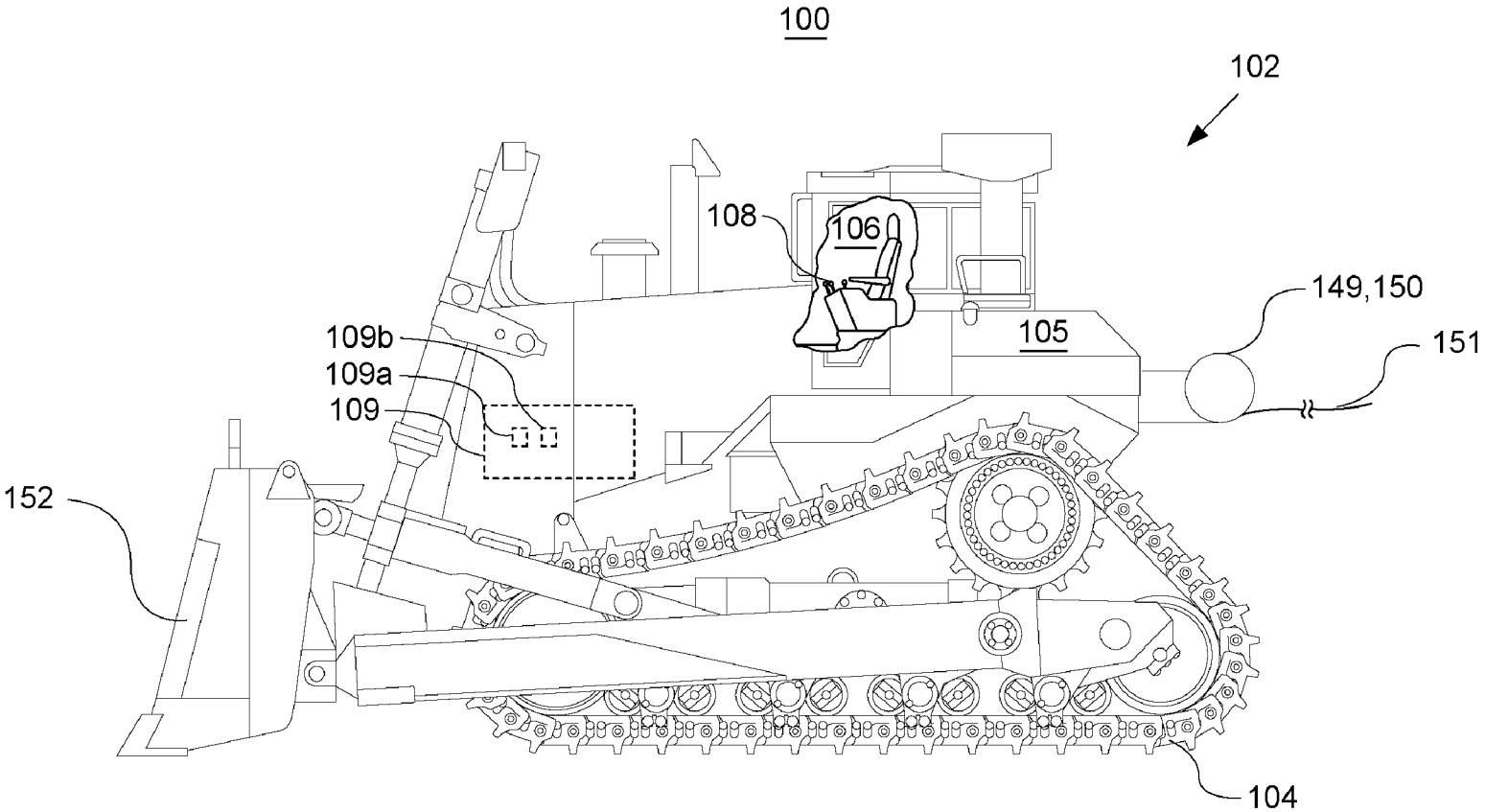
FIG. 1 is a diagrammatic illustration of a machine suitable for use with the present disclosure.

Referring to the drawings, a method and apparatus 100 for operating an implement 149 of a machine 102 is shown.

For example, as exemplified in FIG. 1, the machine 102 is depicted as a track-type tractor. The machine 102 has a body 105 having left and right tracks 104. The machine also has an implement 149, shown as a winch 150 having a line 151, and a dozer blade 152 mounted on the body 105. The machine 102 is suitable for use in a number of earth working operations, such as mining, construction, and the like. However, other types of machines could also be used with the present disclosure, such as, but not limited to, skid-steer loaders, tracked loaders, excavators, pipelayers, forestry machines, agricultural machines, and off-highway vehicles.

An operator station or cab 106 is positioned on the body 105. The operator station 106 may include a rollover protective structure (ROPS) and/or a falling object protective structure (FOPS) enclosing an operator seat. A pair of posts and an overhead guard may frame an optional door (not shown). The operator station 106 has a first operator input device 108, shown as a joystick, although other types of input devices may also be used. For example, control levers, buttons, switches, or any other input device known in the art may also be used. The first operator input device 108 is operable to control the implement 149.

A second operator input device 109 is also operable to control the implement 149. The second operator input device 109 is shown as a first and a second switch 109*a*, 109*b*, respectively, although other configurations may also be used. The first switch 109*a* may be operable to retract or reel-in the line 151 of the winch 150, while the second switch 109*b* may be operable to allow the line 151 to extend by free-spooling the winch 150. The second operator input device 109 is positioned external to the operator station 106. For example, the second operator input device 109 may be positioned behind or on an access panel or service door (not shown) on the body 105 of the machine 102, although the second operator input device 109 may be positioned elsewhere on the machine 102 as well. Alternately, the second operator input device 109 may be a remote control-based unit physically separate from the machine 102.

Figure 2:
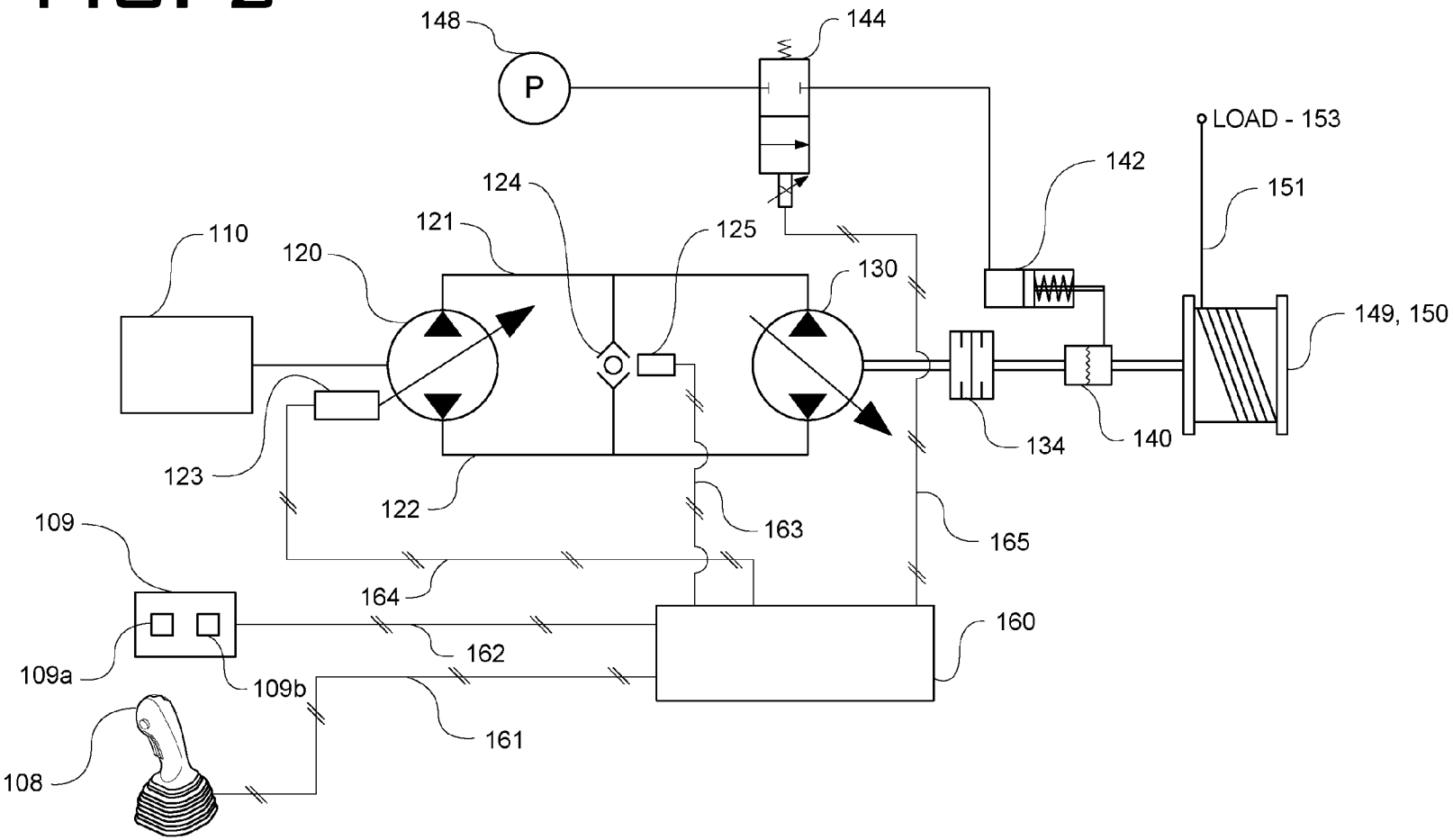
FIG. 2 is a block diagram illustrating a control system for use with the present disclosure.

A control system for the machine 102 is shown in FIG. 2. In this example, an engine 110 provides power to an auxiliary implement pump 120, which ultimately powers the implement 149. A controller 160 receives signals from the first and second operator inputs 108, 109 and controls the implement 149. The engine 110 also powers a pump (not shown) that supplies a source of pressure 148. The engine 110 may be any power source such as, for example, a diesel engine, a gasoline engine, a gaseous fuel driven engine, or any other engine known in the art. It is contemplated that the engine 110 may alternately include another source of power such as a fuel cell, a power storage device, an electric or hydraulic motor, and/or another source of power known in the art. The engine 110 may include an engine speed sensor (not shown) that is adapted to sense the output speed of the engine 110 and direct an engine speed signal representative of the rotational speed of the engine 110 to the controller 160 over a communication line (not shown).

The pump 120 supplies pressurized hydraulic fluid to a winch motor 130 through a first and second hydraulic conduit 121, 122. The pump 120 may be configured to produce a variable output of pressurized fluid and may include a swash plate pump and/or any type of variable displacement pump. A bidirectional pump actuator or solenoid 123 adjusts the swash plate angle of the pump 120, upstroking or downstroking the pump to increase or decrease the pressure supplied to the motor 130. A shuttle valve 124 is coupled to the first and second hydraulic conduits 121, 122, and allows a pressure sensor 125 to read the greater of the pressures in the hydraulic conduits 121 and 122.

The winch motor 130, powered by the pump 120, supplies torque to the implement 149. The implement 149 includes a brake 134 rotationally coupled to the motor 130, a free spool 140 rotationally coupled to the brake, and the winch 150 rotationally coupled to the free spool. The brake 134 may selectively slow down or stop the rotation of the output shaft (not shown) to the winch 150. The free spool 140 serves as a clutch by which a driving connection between two rotatable members operatively couple the motor to the winch. The two halves of the free spool 140 may be selectively engaged or disengaged from each other by a free spool piston 142. A free spool valve 144 controls the operation of the free spool piston 142. The free spool valve 144 is a two-position solenoid valve that is spring biased to a first position. In the first position of the valve 144, the flow through the valve 144 from the source of pressure 148 is blocked, which results in the two halves of the free spool 140 being operatively engaged and allowing torque from the motor 130 to be transmitted to the winch 150. The valve 144 is movable to a second position in response to receipt of an electrical signal from the controller 160. In the second position, the valve 144 allows pressure from the source of pressure 148 to move the free spool piston 142, disengaging the two halves of the free spool 140 from each other and decoupling the winch 150 from the motor 130.

The controller 160 may receive and deliver signals via one or more communication lines. For example, the controller 160 receives implement commands from the first operator interface 108 over a first communication line 161. Similarly, the controller 160 receives implement commands from the second operator interface 109 over a second communication line 162. The controller 160 senses the pressure supplied by the pump 120 in the hydraulic conduit 121, 122 having the higher pressure from pressure sensor 125. The controller 160 controls the pump solenoid 123 via a fourth communication line 164. In addition, the controller controls the free spool valve 144 via a fifth communication line 165. It is contemplated that the received and delivered signals may be any known signal format, such as, for example, a current or a voltage level. The controller 160 may be positioned in the body 105 of the machine 102 and may be an electronic control module and may also include one or more microprocessors, a memory, a data storage device, a communications hub, and/or other components known in the art. It is contemplated that the controller 160 may be further configured to receive additional inputs (not shown) indicative of various operating parameters of the machine 102 and or additional components, such as, for example, temperature sensors, positions sensors, and/or any other parameter known in the art. It is also contemplated that the controller 160 may be preprogrammed with parameters and/or constants indicative of and/or relating to the machine 102.

INDUSTRIAL APPLICABILITY

Figure 3:
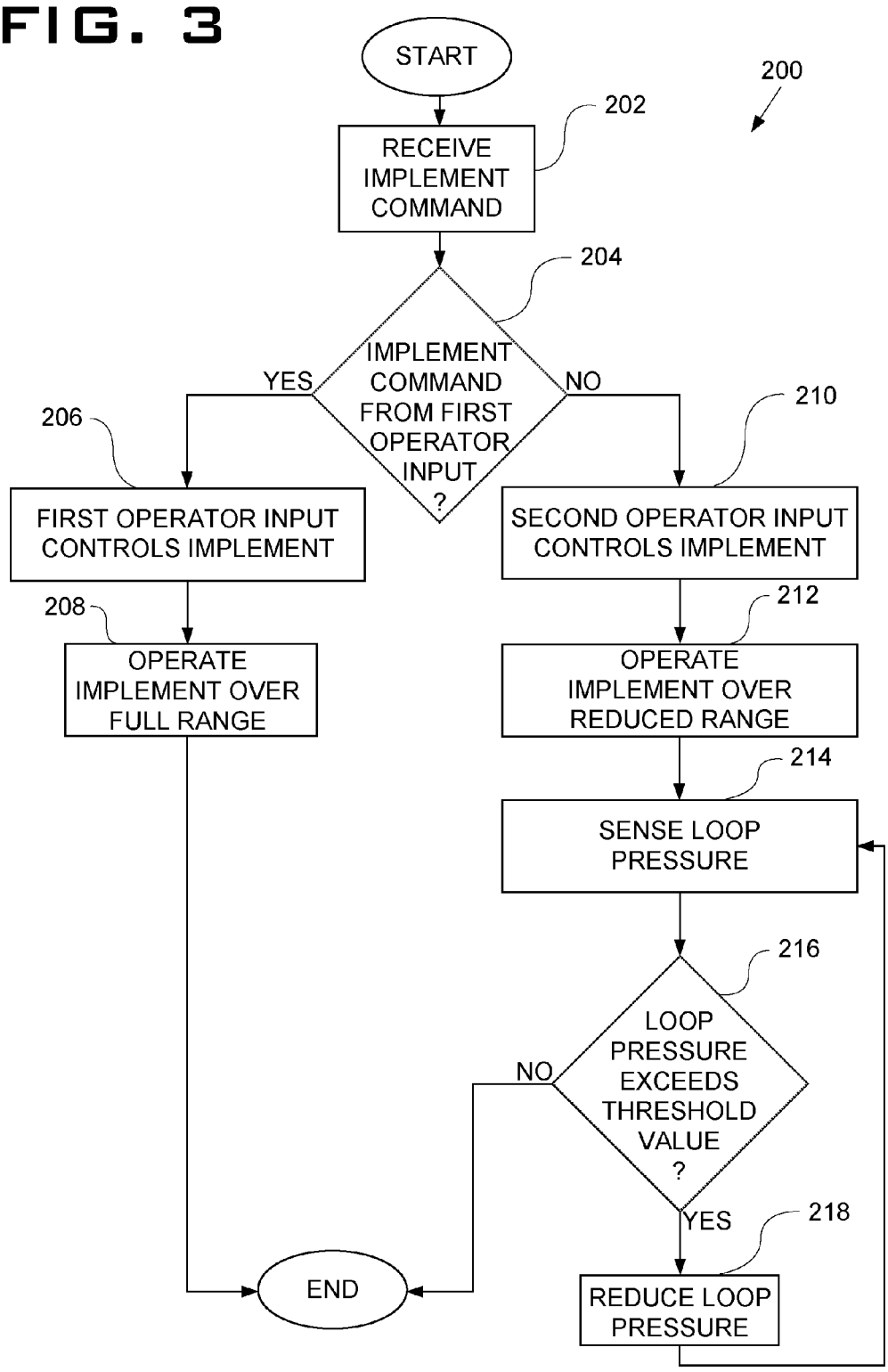
FIG. 3 is a block diagram illustrating an exemplary method for operating an implement for a machine.

FIG. 3 is a flow diagram illustrating a method for operating the implement 149 of the machine 102 and is discussed below.

In a first control block 202, the controller 160 receives an implement command. For example, an operator may engage the first operator input device 108 while in the operator station 106, or may engage the second operator input device 109 while outside of the operator station 106. In a second decision block 204, the controller 160 determines whether the implement command came from the first operator input 108. The controller 160 may use the status of communication lines 161, 162, a seat position sensor (not shown), a timer, or other techniques known in the art to distinguish between commands between the first and the second operator input devices 108, 109. Alternately, if conflicting or concurrent commands are sent by both the first and second operator input devices 108, 109, the controller 160 may limit the implement to the lesser of the commands from the first and the second operator input devices 108, 109.

If the controller 160 determines that the first operator input 108 sent the implement command, a third control block 206 sets the controller 160 to have the first operator input 108 control the implement 149. In a fourth control block 208, the controller operates the implement 149 over its full motor torque range, permitting the winch 150 or implement 149 to operate up to its maximum power. The controller 160 may apply a scaling factor, a function, a look-up table or map that is based on various machine parameters, or any other technique known in the art to the implement command. The controller 160 controls the winch 150 by supplying an electrical signal, such as a current, over the fourth communication line 164 to the pump solenoid 123. The pump solenoid 123 adjusts the swash plate of the pump 120, increasing or decreasing the pressure supplied to the motor 130. The pump 120 may be bidirectional, capable of supplying pressurized hydraulic fluid over either hydraulic conduit 121 or 122 to the motor 130. In a reel-in direction, pressurized fluid is supplied over hydraulic conduit 121 to the motor 130, and returning to the pump over hydraulic conduit 122. In the reel-in mode, the winch 150 will reel-in the line 151, pulling a load 153 towards the winch 150. In contrast, if hydraulic fluid is first supplied over hydraulic conduit 122, the motor 130 will reverse direction, causing the winch 150 to reel-out the line 151.

If the controller 160 determines that the second operator input 109 sent the implement command, a fifth control block 210 sets the controller to have the second operator input 109 control the implement 149. A sixth control block 212 has the controller 160 operate the implement 149 over a reduced range. In one exemplary embodiment, this reduced range may be approximately one percent of the full range of motor torque or line pull available to the winch 150, although the limit may be changed depending on the application, machine, and model. In addition, the controller 160 may also correct for the changing radius off of the drum (not shown) of the winch 150 with varying torques available depending on the diameter of the line 151, the number of coils of the line 151, etc. The implement 149 may be operated over a reduced range by controlling the pump 120. A signal may be applied over the communication line 164 that limits the actuation of the pump solenoid 123, which in turn limits the angle of the swash plate. This restricts the pressure supplied to the motor 130, and limits the torque available to the winch 150.

A seventh control block 214 senses the pump-motor loop pressure. As described above, the pressure sensor 125 reads the higher pressure in the first hydraulic conduit 121 and the second hydraulic conduit 122 through the shuttle valve 124. The pressure sensor 125 communicates that pressure to the controller 160 via the third communication line 163.

An eighth control block 216 determines whether the sensed loop pressure exceeds a threshold value. If the pressure in the loop exceeds the threshold value, the controller 160 reduces the loop pressure in a ninth control block 218. The controller 160 sends a signal over the fourth communication line 164 to the pump solenoid 123 to downstroke the swash plate of the pump 120, ultimately reducing the torque supplied by the motor 130 to the winch 150. The loop pressure would again be sensed as in the seventh control block 214. If the pressure in the loop is below the threshold value, the algorithm would end and wait for another implement command.

As an example of an application of the present disclosure, an operator may operate the winch 150 of the machine 102 at a desired line pull. If the operator uses the first operator input device 108 located within the operator station 106, the controller 160 allows the implement 149 to be operated over its full range, with no reduction in capacity.

However, if the controller 160 detects that the first switch 109*a* of the second operator input device 109 is used, the controller 160 senses the pressure supplied by the pump 120. The controller 160 then limits the available line pull to a reduced range. This reduction may allow an operator to pull the line 151 taught without having to repeatedly enter and exit the operator station 106.

If the second switch 109*b* of the second operator input device 109 is used, the controller 160 sends a signal over the fifth communication line to the free spool valve 144, shifting the valve 144 to the second position. This second position allows pressurized fluid to move the free spool piston 142 and disengage the two rotatable members of the free spool 140 from each other, rotatably disengaging the winch 150 from the motor 130.

While the disclosure has been described with reference to details of the illustrated embodiments, these details are not intended to limit the scope of the disclosure as defined in the appended claims. For example, other hydraulic control systems known in the art may be used to control the winch 150. Other aspects, objects, and features of the present disclosure can be obtained from a study of the drawings, the disclosure, and the appended claims.

What is claimed is:

1. A machine comprising:

a body;

a pump mounted to the body and having a first operating range;

an implement mounted to the body and coupled to the pump;

an operator station positioned on the body;

a first operator input device located within the operator station and operable to control the implement over the first operating range; and a second operator input device positioned external to the operator station and operable to control the implement over a second operating range, wherein the second operating range is less than the first operating range.

2. The machine of claim 1, further comprising:

an engine located within the body and powering the pump; and a motor powered by the pump and coupled to the implement.

3. The machine of claim 2, further comprising:

a pressure sensor configured to sense the pressure of the pump;

a controller in communication with the pressure sensor, the first operator input, and the second operator input, and operable to control the implement.

4. The machine of claim 3, wherein the implement is a winch.

5. The machine of claim 4, wherein the machine is a track-type tractor.

6. The machine of claim 4, wherein the second operating range is approximately one percent of the first operating range.

7. The machine of claim 4, further comprising a clutch coupled to the motor and the winch, wherein the second operator input is operable to selectively engage and disengage the clutch.

8. A method of operating an implement for a machine, the machine having a body, a pump mounted to the body that powers the implement over a first operating range, an operator station positioned on the body, a first operator input device located within the operator station, and a second operator input device positioned external to the operator station, including the steps of:

operating the implement over the first operating range when a command from the first operator input device is received;

operating the implement over a second operating range when a command from the second operator input device is received, wherein the second operating range is less than the first operating range.

9. The method of claim 8, where the machine includes an engine located within the body powering the pump, a motor powered by the pump and powering the implement, and further includes the steps of:

sensing the pressure supplied by the pump; and reducing the pressure supplied by the pump if the sensed pressure exceeds a threshold value.

10. The method of claim 9, wherein the implement is a winch.

11. The method of claim 10, wherein the machine is a track-type tractor.

12. The method of claim 10, wherein the second operating range is approximately one percent of the first operating range.

* * * * *